US007278928B2

(12) United States Patent
Newman et al.

(10) Patent No.: US 7,278,928 B2
(45) Date of Patent: Oct. 9, 2007

(54) GOLF CLUB STRIKING FACE

(75) Inventors: Martin Newman, Sharon, MA (US); Nick Frame, Carlsbad, CA (US); Bret Wahl, Escondido, CA (US); Bing Ling Chao, San Diego, CA (US); Benoit Vincent, Leucadia, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 10/723,994

(22) Filed: Nov. 25, 2003

(65) Prior Publication Data

US 2005/0113186 A1 May 26, 2005

(51) Int. Cl.
*A63B 53/04* (2006.01)

(52) U.S. Cl. ..... 473/342

(58) Field of Classification Search ..... 473/342, 473/324, 282, 131, 330, 331
See application file for complete search history.

(56) References Cited

U.S. PATENT DOCUMENTS

| | | | | |
|---|---|---|---|---|
| 722,927 | A * | 3/1903 | Swift | 473/330 |
| 732,136 | A | 6/1903 | Taylor | |
| 749,174 | A * | 1/1904 | Davis | 473/246 |
| 1,094,599 | A | 4/1914 | Samson | |
| 1,289,553 | A | 12/1918 | Sanders | |
| 1,337,958 | A | 4/1920 | Reach | |
| D57,980 | S | 5/1921 | Kraenter | |
| D63,284 | S | 11/1923 | Challis | |
| 1,494,494 | A | 5/1924 | Lippincott | |
| 1,524,731 | A | 2/1925 | Davis | |
| 1,526,951 | A | 2/1925 | Bessmont | |
| 1,532,545 | A | 4/1925 | Pederson | |
| 1,535,670 | A | 4/1925 | Kidd | |
| 1,595,589 | A | 8/1926 | Tyler | |
| 1,646,461 | A | 10/1927 | So Relle | |
| 1,654,257 | A | 12/1927 | Hillerich | |
| 1,659,272 | A | 2/1928 | Link | |
| D79,684 | S | 10/1929 | Munro-Spencer | |
| 1,968,626 | A | 7/1934 | Young | |
| D138,380 | S | 7/1944 | Myers et al. | |
| 2,429,351 | A | 10/1947 | Fetterolf | |
| 3,211,455 | A | 10/1965 | Hyden | |
| 3,869,126 | A | 3/1975 | Thompson | |
| 4,027,885 | A | 6/1977 | Rogers | |
| 4,156,526 | A | 5/1979 | Huggins et al. | |

(Continued)

OTHER PUBLICATIONS

Photon Golf, Inc., "Laser Nanogroove Technology," Sep. 15, 2003, http://www.photongolf.com/Int.htm.

(Continued)

*Primary Examiner*—Eugene Kim
*Assistant Examiner*—M. Chambers
(74) *Attorney, Agent, or Firm*—Sheppard, Mullin, Richter & Hampton LLP

(57) ABSTRACT

A golf club head in accordance with the invention includes a forward striking face that comprises a substantially planar recessed surface and a plurality of discrete, solid geometric shapes projecting forward from the recessed surface. Each of the geometric shapes has a volume of less than 0.0007 $mm^3$. The distance along the recessed surface between adjacent shapes is at least 0.1 mm. The total volume of the geometric shapes contained with a square reference region measuring 2.5 mm by 2.5 mm is less than 0.05 $mm^3$.

14 Claims, 5 Drawing Sheets

U.S. PATENT DOCUMENTS 4,413,825 A 11/1983 Sasse
4,422,638 A 12/1983 Tucker
4,508,349 A 4/1985 Gebauer et al.
4,529,203 A 7/1985 Ribaudo
4,679,792 A 7/1987 Straza et al.
4,681,322 A 7/1987 Straza et al.
4,740,345 A 4/1988 Nagasaki et al.
4,768,787 A 9/1988 Shira
4,884,808 A 12/1989 Retzer
4,964,641 A * 10/1990 Miesch et al. ..... 473/330
4,999,000 A 3/1991 Finney
5,083,778 A 1/1992 Douglass
D340,492 S 10/1993 Flood
5,301,941 A 4/1994 Allen
5,332,214 A 7/1994 Tucker, Sr.
5,358,249 A 10/1994 Mendralla
5,403,007 A 4/1995 Chen
5,405,136 A 4/1995 Hardman
5,407,196 A 4/1995 Busnardo
5,437,088 A 8/1995 Igarashi
5,445,386 A 8/1995 Marshall
5,447,311 A 9/1995 Viollaz et al.
5,458,332 A 10/1995 Fisher
5,482,282 A 1/1996 Willis
D368,126 S 3/1996 Magerman et al.
5,505,450 A 4/1996 Stuff
5,524,331 A 6/1996 Pond
5,531,439 A 7/1996 Azzarella
5,542,675 A 8/1996 Micciche et al.
5,573,469 A 11/1996 Dekura
5,620,381 A 4/1997 Spalding
5,674,132 A 10/1997 Fisher
5,688,190 A * 11/1997 Rowland et al. ..... 473/330
5,690,562 A 11/1997 Sturm
5,704,850 A 1/1998 Shieh
5,716,290 A 2/1998 Baker et al.
5,766,093 A 6/1998 Rohrer
5,800,285 A 9/1998 Thorne et al.
5,807,190 A 9/1998 Krumme et al.
5,879,243 A 3/1999 Hackman
D411,275 S 6/1999 Bottema et al.
5,921,871 A 7/1999 Fisher
5,924,939 A 7/1999 Grace et al.
D415,809 S 10/1999 Bottema et al.
6,007,434 A * 12/1999 Baker et al. ..... 473/330
6,089,993 A 7/2000 Woodward et al.
6,110,057 A * 8/2000 McKinnon ..... 473/313
6,277,033 B1 8/2001 Krumme et al.
6,348,011 B1 * 2/2002 Reyes et al. ..... 473/324
6,381,828 B1 5/2002 Boyce et al.
6,435,980 B1 * 8/2002 Reyes et al. ..... 473/324
2002/0091014 A1 7/2002 Aldrich
2003/0060306 A1 3/2003 Aldrich

OTHER PUBLICATIONS

Photon Golf, Inc., "Laser Surface Modification," Sep. 15, 2003, http://www.photongolf.com/Ism.htm.

* cited by examiner

GOLF CLUB STRIKING FACE

BACKGROUND OF THE INVENTION

This invention relates generally to golf clubs and, more particularly, to an improved striking face for a golf club head and to a method for manufacturing it.

One of several factors affecting a golfer's ability to obtain the desired distance and accuracy when using a specific golf club is the nature of the contact between the striking face of the club head and the golf ball. Specifically, the type and duration of the contact between the striking face and ball are affected by several factors, including the materials used for the striking face and the ball, and also including the surface geometry of the striking face.

The striking face typically has a surface geometry that includes a groove or scoreline pattern having the form of linear segments and/or indentations. An alternative surface geometry for the striking face is sometimes provided by a media blasting method, e.g., using sand or ceramic glass beads, or by a milling method, in which the entire striking face, or a major part of it, is provided with a pattern that either is randomly distributed or is relatively controlled. Sand blasting and similar methods can undesirably create a texture having uneven depth across the striking face. Milling methods typically produce a mill mark pattern of substantially continuous, curvilinear grooves.

Another method for forming a surface geometry that enhances the contact between the striking face and the golf ball is to stamp or cast a desired pattern directly onto a front wall of the club head or onto a separate plate that is attached as the striking face. Casting methods typically require a subsequent polishing step to clean the surface and, therefore, do not always provide the desired pattern. Stamping and milling precision is limited by the equipment and processes. Stamping, for example, often results in material spring-back that undesirably reduces the accuracy of the desired surface features. Similarly, milling machines typically use relatively large end bits that are contoured and thus provide radiused junctions instead of the desired sharply stepped formations.

Yet another method for forming the desired surface geometry is to add different materials to the striking face surface. Particulate matter, e.g., diamond material, carbide particles embedded in a copper matrix, or resin combined with fibers or such, have been used to modify the surface geometry.

It should, therefore, be appreciated that there is a need for a golf club face plate having an improved geometry, configured to enhance the contact with a golf ball without being vulnerable to the problems described above. The present invention satisfies this need and provides further related advantages.

SUMMARY OF THE INVENTION

The present invention is embodied in a golf club head having a forward striking face that comprises a substantially planar recessed surface and a plurality of discrete, solid geometric shapes projecting forward from the recessed surface. Each of the geometric shapes has a volume of less than 0.0007 $mm^3$. The distance along the recessed surface between adjacent shapes is at least 0.1 mm. The total volume of the geometric shapes contained with a square reference region measuring 2.5 mm by 2.5 mm is less than 0.05 $mm^3$.

Preferably, the geometric shapes are identical in size and shape across the forward striking face. The geometric shapes preferably are square or diamond, although other geometric shapes also can be created.

In an optional feature of the invention, the engineered texture can include a prescribed pattern of a first plurality of geometric shapes and a second plurality of geometric shapes. The first plurality of shapes preferably are positioned adjacent to the second plurality of shapes.

The invention also resides in a method of manufacturing a golf club face plate of the kind described above. Preferred methods include chemical etching, precision micro saw-cutting, and laser cutting. Grooves forming a scoreline pattern can be provided on the striking surface, as well.

In forming a complete golf club head, the golf club face plate can be integrally formed with a body of the club head, or it can be separately formed as a face plate that is attached to the body. The invention can be advantageously used in a wood-type head (loft angle less than about 15°), a utility-type club head (loft angle less than about 25°) or an iron-type club head (loft angle at least about 18°). The invention provides particular advantages for a wedge-type club head (loft angle greater than about 45°).

For purposes of summarizing the invention and the advantages achieved over the prior art, certain advantages of the invention have been described. Of course, it is to be understood that all such advantages might not be achieved by any one particular embodiment of the invention. Those skilled in the art will recognize that the invention can be embodied or carried out in a manner that achieves or optimizes one advantage, or group of advantages, as taught herein, without necessarily achieving other advantages taught or suggested herein.

All of these embodiments are intended to be within the scope of the invention herein disclosed. These and other embodiments of the present invention will become readily apparent to those skilled in the art from the following detailed description of the preferred embodiments, having reference to the attached illustrative figures. The invention is not limited to any particular preferred embodiment(s) disclosed.

DETAILED DESCRIPTION OF THE PREFERRED EMBODIMENTS

Figure 1:
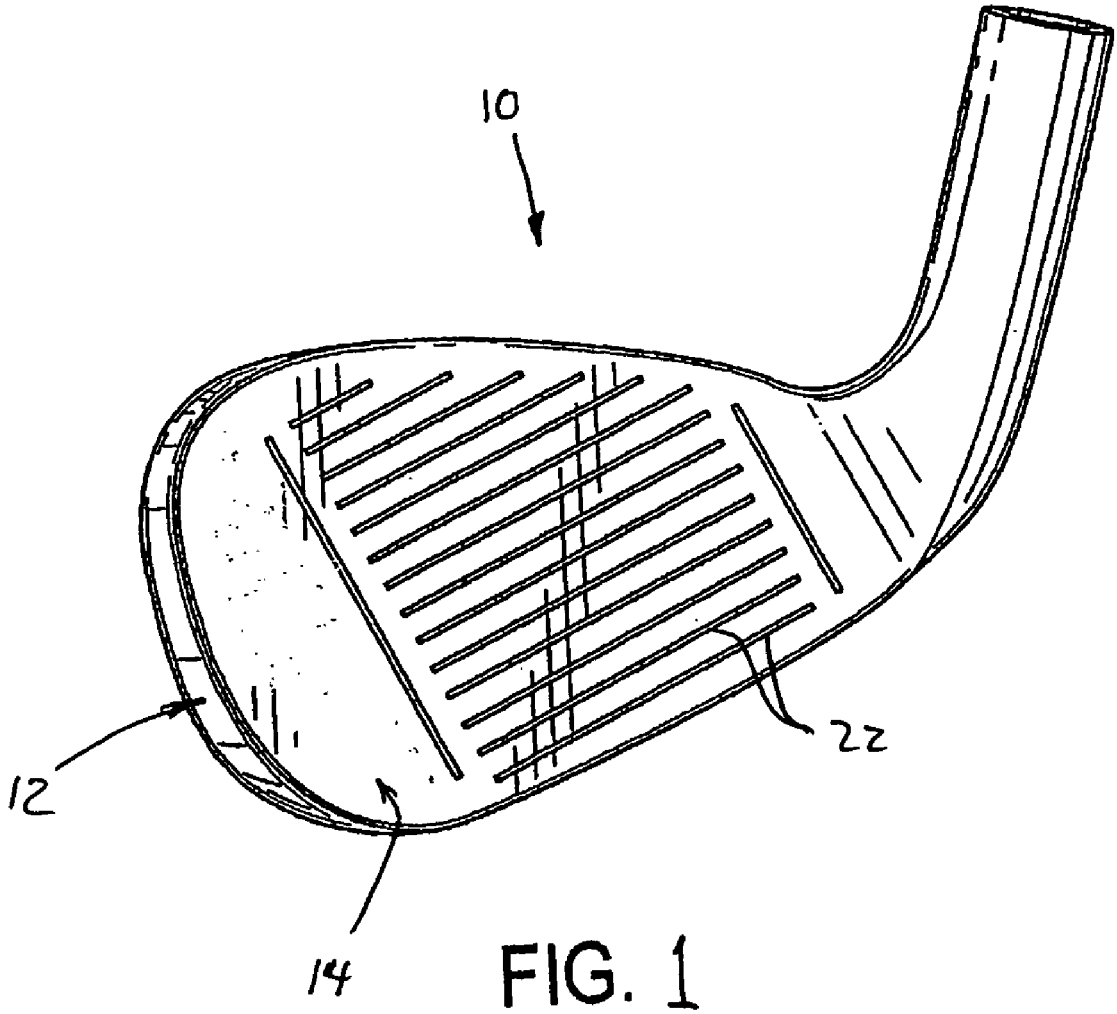
FIG. 1 is a perspective view of a first embodiment of a golf club head in accordance with the invention.

With reference now to the exemplary drawings, and particularly to FIG. 1, there is shown an iron-type golf club head 10 having a front wall 12 that defines a forward striking surface or face 14. Although the invention has applicability to any kind of golf club, including wood-type clubs, iron-type clubs and putter-type clubs, it has particular advantages for iron-type clubs having loft angles greater than about 45°, i.e., wedges. The front wall preferably is integrally formed with at least a sole portion of a body. Alternatively, the front wall can be a face plate that is separately formed and attached, e.g., by welding, to the front of a club body having a top portion, a toe portion, a heel portion, and a sole portion.

Figure 3:
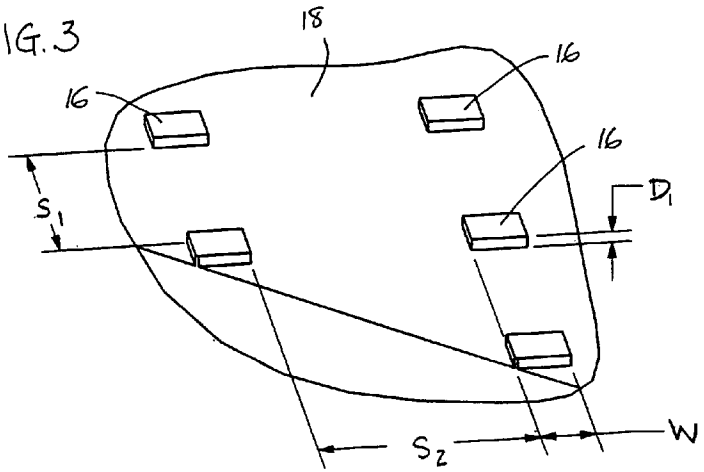
FIG. 3 is a further enlarged view of detail A of FIG. 2.
Figure 2:
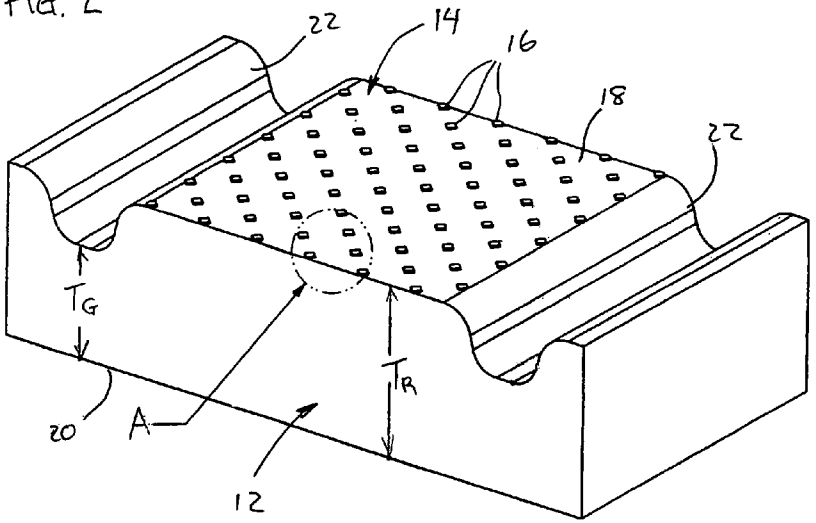
FIG. 2 is an enlarged perspective view of a portion of the forward striking face of the golf club head of FIG. 1, located between two adjacent scorelines.

With reference now to FIGS. 2 and 3, there is shown an engineered texture on the forward striking face 14, for providing enhanced performance upon striking a golf ball (not shown). The engineered texture has the form of a prescribed pattern of discrete, geometric shapes 16, each having a volume of less than 0.0007 $mm^3$, preferably less than 0.0005 $mm^3$ and most preferably less than 0.0003 $mm^3$, and spaced at least 0.1 mm apart each other. The geometric shapes preferably all have the same size and shape, preferably square or diamond, although other shapes, e.g., circles, alternatively could be used.

Figure 8:
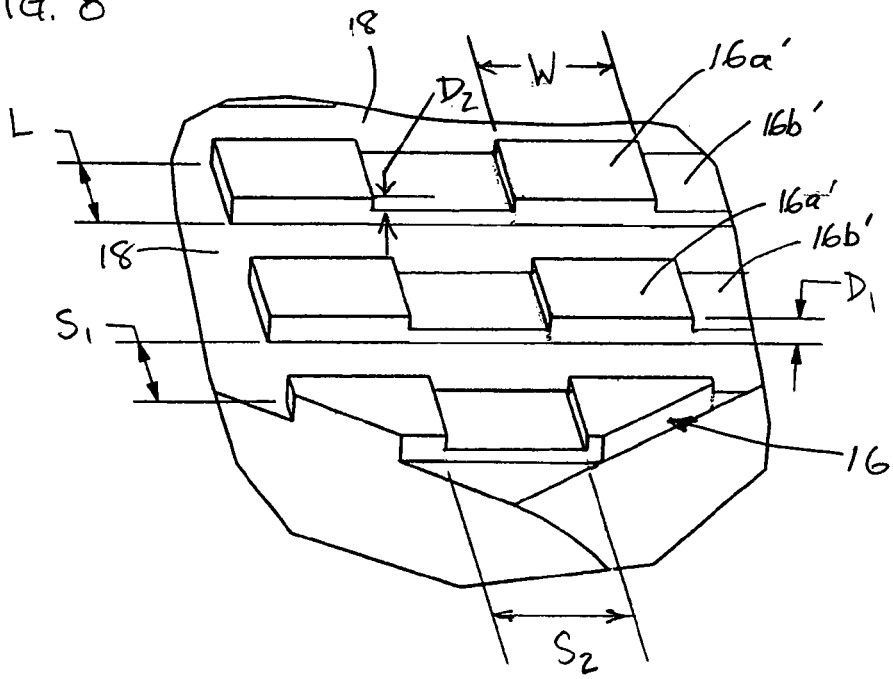
FIG. 8 is an enlarged view, similar to FIG. 3, of a fifth embodiment of a golf club striking face in accordance with the invention.

The geometric shapes 16 project forward from a recessed surface 18, and each has a width W, a length L, and a depth D1. The depth D1 preferably is at least 0.0125 mm (0.0005 inches). Each geometric shape thus has a volume calculated to be W×L×D1. An alternative embodiment, such as shown in FIG. 8, can include geometric shapes 16' having first portions 16*a'* and contiguous second portions 16*b'*. The first portions have a height D1, and the second portions have a height D1-D2.

The front wall 12 further includes a rearward surface 20 (FIG. 2), opposite the forward striking face 14. A thickness TR is measured between the rearward surface and the recessed surface 18 of the forward striking face. A maximum distance, measured normal to the rearward and forward surfaces, is equal to TR+D1. A plurality of grooves define parallel scorelines 22 in the forward striking surface, forming a thickness TG that is less than the thickness TR. The scorelines are formed parallel to each other, according to guidelines of the United States Golf Association (USGA).

Figure 4:
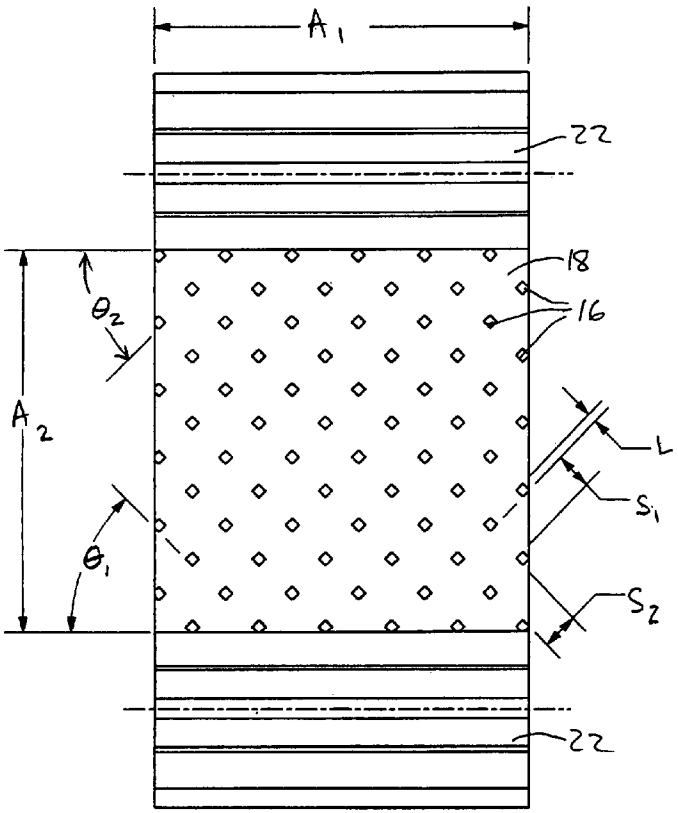
FIG. 4 is a plan view of the portion of the forward striking face shown in FIG. 2.
Figure 5:
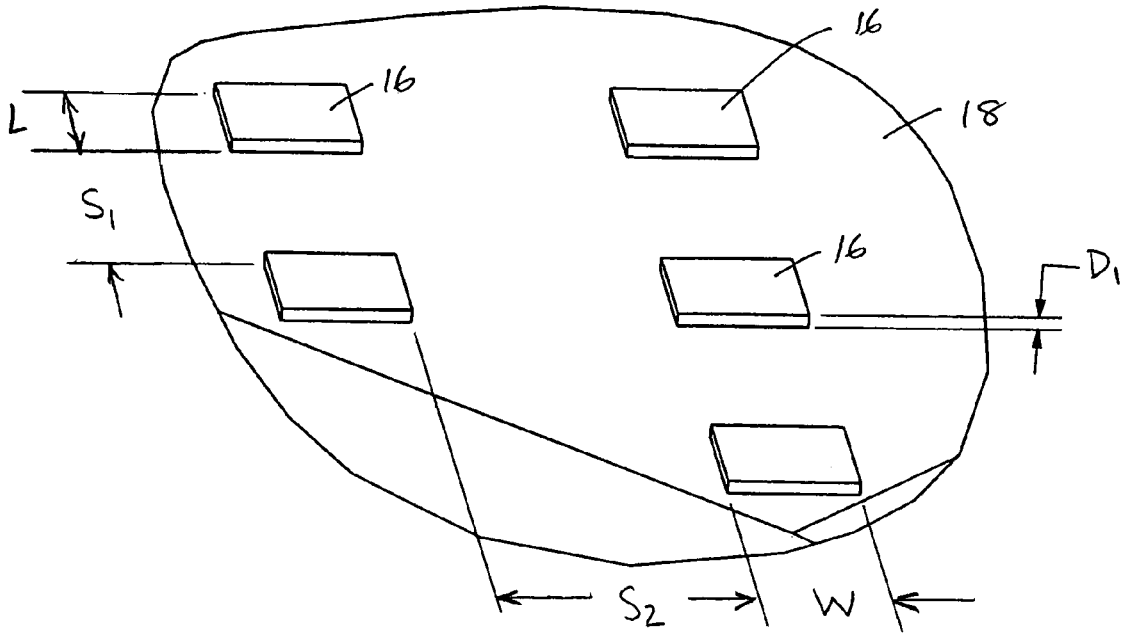
FIG. 5 is an enlarged view, similar to FIG. 3, of a second embodiment of a golf club striking face in accordance with the invention.
Figure 6:
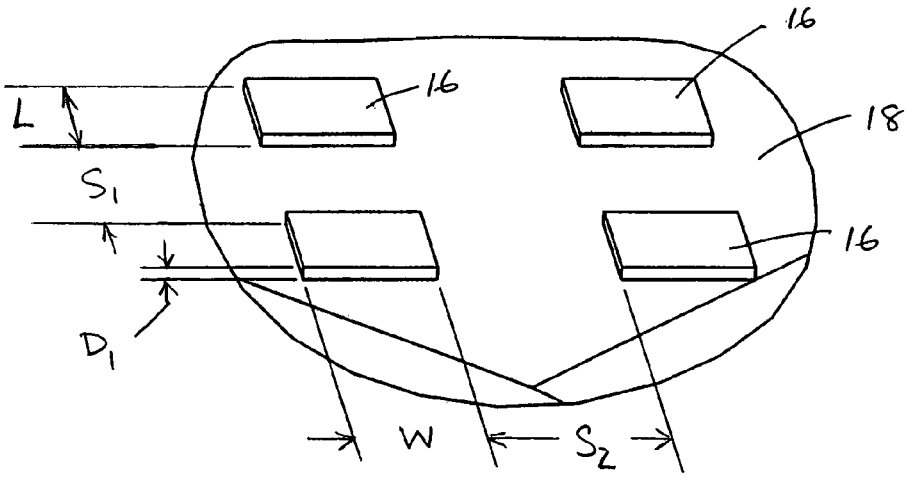
FIG. 6 is an enlarged view, similar to FIG. 3, of a third embodiment of a golf club striking face in accordance with the invention.
Figure 7:
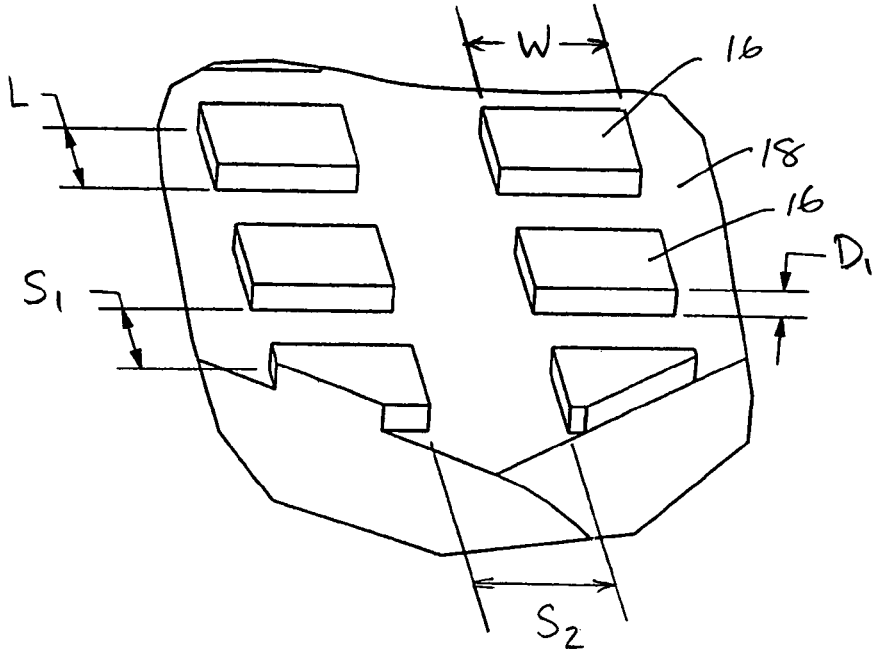
FIG. 7 is an enlarged view, similar to FIG. 3, of a fourth embodiment of a golf club striking face in accordance with the invention.

FIG. 4 depicts the square geometric shapes 16 to be spaced substantially evenly across the forward striking face 14. These shapes form rows and columns having spacings S1, S2, and they are oriented at angles $\theta_1$, $\theta_2$ relative to the scorelines 22. A preferred orientation of the pattern is $\theta_1=\theta_2=45°$, although orientations of 0°, 30°, and 60°, or combinations of such orientations, alternatively can be provided. For example, orientations of $\theta_1=60°$ and $\theta_2=30°$, or $\theta_1=\theta_2=30°$, can be provided.

A reference area of the striking face 14 is defined between two adjacent scorelines 22 is shown in FIG. 4, covering a width A1 and a length A2, which is about 2.5 mm×2.5 mm (0.1 inch×0.1 inch). In one detailed feature of the invention, the pattern of geometric shapes 16 has a total volume over such reference area that preferably is less than 0.05 $mm^3$, more preferably is less than 0.02 $mm^3$, and most preferably is less than 0.01 $mm^3$. In comparison, a solid faceplate portion covering about 2.5 mm×2.5 mm×0.0125 mm (0.1 inch×0.1 inch×0.0005 inch) has a volume of about 0.08 $mm^3$. Preferably, the total volume of the geometric shapes is less than about 25%, and more preferably is less than about 15%, of the comparable portion for a solid faceplate.

While the geometric shapes 16 provided on a particular forward striking face 14 preferably are identical to each other, they need not be. Specifically, in alternative embodiments, the pattern can take the form of two or more different geometric shapes, preferably located in groups or clusters of identical shapes across the striking face. The width and length of the shapes also can be varied within the pattern, as desired. Also, the orientation of the shapes can vary across the striking surface so that the resulting pattern can have shapes, e.g., at 30° and 60° orientations. FIGS. 5-8 illustrate second, third, fourth, and fifth embodiments, respectively.

Tables 1 and 2 set forth properties for several forward striking faces that have been manufactured and tested. A single orientation angle $\theta_1$ is assumed, unless indicated otherwise, e.g., ($\theta_1$, $\theta_2$) for Plate ID No. 3. Plate ID No. 7 has a second depth D2 for its geometric shapes (see FIG. 8).

Figure 10:
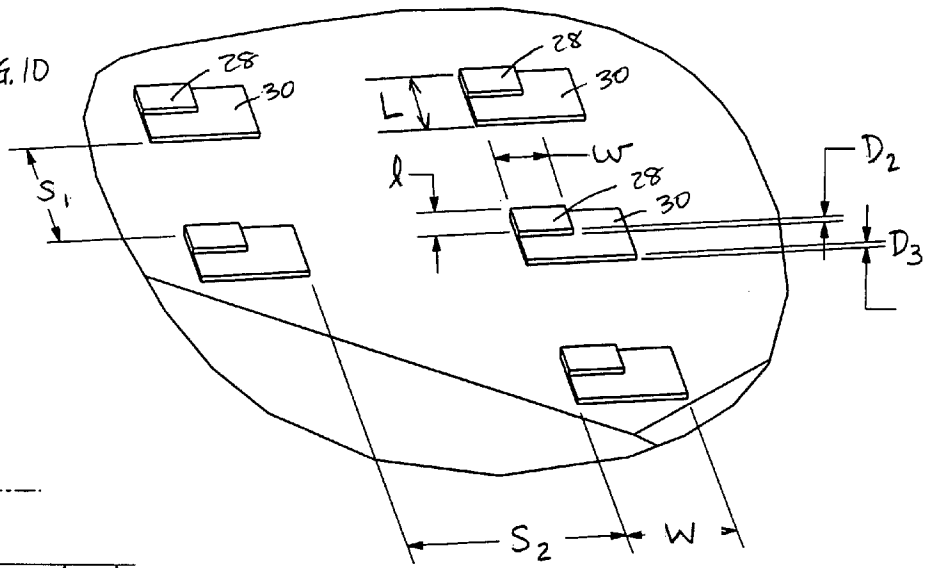
FIG. 10 is a further enlarged view of detail B of FIG. 9.
Figure 9:
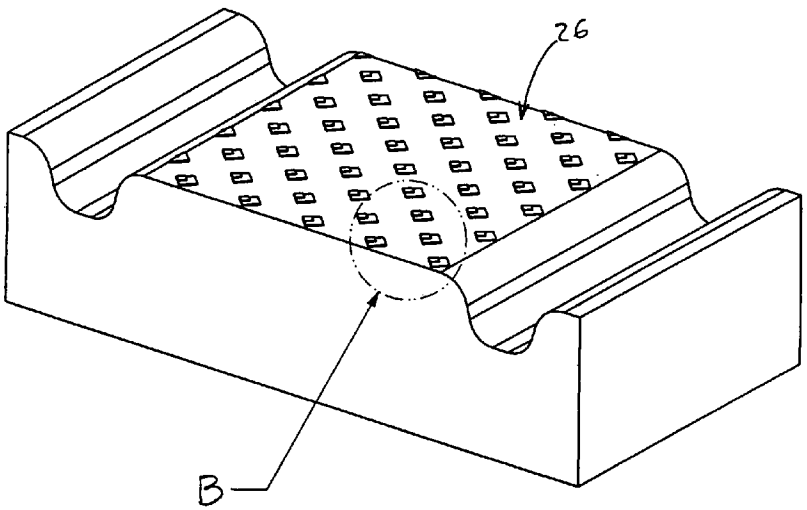
FIG. 9 is an enlarged perspective view of a portion between two adjacent scorelines in a sixth embodiment of a golf club striking face in accordance with the invention.
Figure 11:
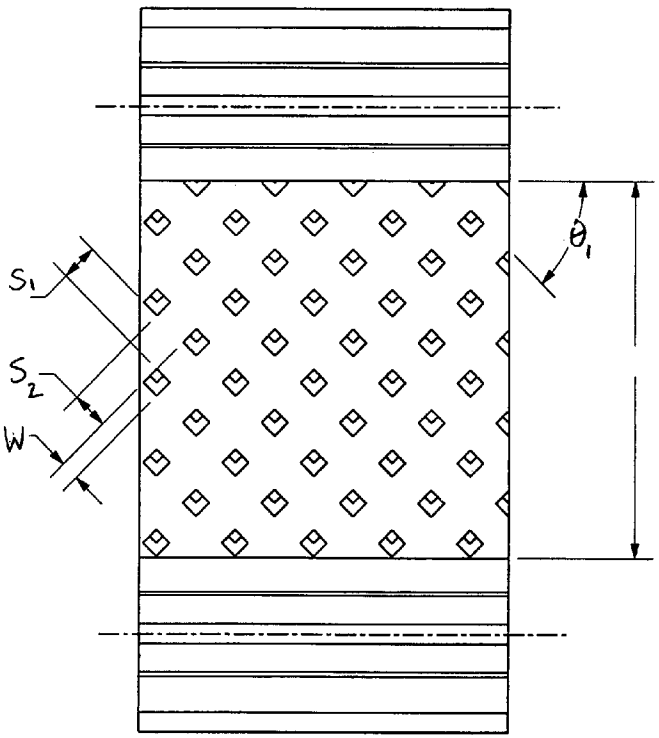
FIG. 11 is a plan view of the portion of the striking face shown in FIG. 9.

FIGS. 9-11 illustrate a sixth embodiment of a golf club head in accordance with the present invention, identified as Plate ID No. 1 in Tables 1 and 2. The forward striking face 26 of this embodiment has a special two-level geometric pattern that includes a smaller shape 28, of dimensions l×ω×$D_2$, formed on the forward surface of a larger shape 30, of dimensions L×W×D3. In this embodiment, D2+D3=D1. Preferably, the smaller shape has a common corner with the larger shape; however, the smaller shape may be placed anywhere on the forward surface of the larger shape. The total volume for this particular two-part shape is determined to be the sum of the volumes of the smaller and larger shapes.

TABLE 1

Preferred Face Embodiments of the Present Invention

| Plate ID | Width W (mm) | Length L (mm) | Spacing 1 S1 (mm) | Spacing 2 S2 (mm) | Depth 1 D1 (mm) | Orientation $\theta_1$ (deg) |
|---|---|---|---|---|---|---|
| No. 1 | 0.127 | 0.127 | 0.254 | 0.254 | 0.0127 | 45 |
| | (ω = 0.0635) | (l = 0.0635) | | | (D2 = D3 = 0.00635) | |
| No. 2 | 0.127 | 0.127 | 0.254 | 0.254 | 0.0127 | 45 |
| No. 3 | 0.127 | 0.127 | 0.254 | 0.254 | 0.0127 | 30, 60 |
| No. 4 | 0.127 | 0.127 | 0.254 | 0.254 | 0.0127 | 30 |
| No. 5 | 0.0635 | 0.0635 | 0.254 | 0.254 | 0.0127 | 45 |
| No. 6 | 0.127 | 0.127 | 0.1778 | 0.1778 | 0.0127 | 45 |
| No. 7 | 0.127 | 0.127 | 0.254 | 0.254 | 0.0127 | 45 |
| | | | | | (D2 = 0.00635) | |

TABLE 2

Volumes of Patterns of Geometric Shapes Forming Engineered Texture

| Plate ID | Volume of Each Shape ($mm^3$) | Volume Over Reference Area ($mm^3$) | % Volume of Geometric Shapes |
|---|---|---|---|
| No. 1 | 0.000128 | 0.005734 | 7 |
| No. 2 | 0.000205 | 0.009276 | 11 |
| No. 3 | 0.000205 | 0.009013 | 11 |
| No. 4 | 0.0001774 | 0.006476 | 8 |
| No. 5 | 0.0000512 | 0.003686 | 4.5 |
| No. 6 | 0.000205 | 0.01476 | 18 |
| No. 7 | 0.000205 | 0.01817 | 22 |

Various methods have been investigated for creating the discrete, geometric shapes 16 having the properties described above. These methods include laser surface machining, or laser cutting, chemical etching, and precision micro-saw-cutting.

One laser cutting method is disclosed, for example, in U.S. Patent Application Publication No. 2003/0060306 A1, published Mar. 27, 2003. Generally, the laser cutting method uses highly focused optical power to remove metal from a surface. Two types of lasers, $CO_2$ and Nd-YAG lasers, are suitable for use in accordance with the invention, at power levels ranging from 500 W to 4000 W and operating in either a continuous-wave mode or a pulsed mode. In this method, a laser beam scans across the metal surface according to a preprogrammed path. The beam's focus and scan speed are adjusted to achieve the desired depth of penetration. To achieve the desired pattern of discrete, geometric shapes, a precise control must be maintained over the operating environment. This includes control of factors such as beam scan speed, beam focus, management of the resulting smoke, and cleaning of the surface. A laser beam diameter in the range of 0.01 mm to 0.5 mm may be used, with a diameter of 0.25 mm being preferred. Specific laser operating parameters are determined according to the pattern to be created on the striking surface.

The chemical etching method is a wet process, similar to that used for printed circuit boards (PCBs) and decorative metal finishes having relief patterns. One example of this method, for uniformly removing a thin layer of material from a forged striking plate, is described in U.S. Pat. No. 6,381,828. In the present invention, the chemical etching method includes designing a specific desired striking face pattern and then preparing the metal surface by cleaning with an alkaline cleaner, a sulfuric acid dip, and de-ionized water. The metal faceplate, or club head body with integral striking surface, is then dipped into a tank of wet chemical photoresist compound. Slowly raising the metal part from the tank yields a layer of photoresist having a controlled thickness. The layer then is dried and exposed to the environment. During exposure, the pattern of discrete, geometric shapes is transferred to the surface of the photoresist layer.

The exposed photoresist layer then is developed, to remove areas where etching is desired. That is, areas of the metal surface that are not intended to be etched away are protected by the photoresist remaining on the surface after the exposure and development. The developed part is etched in an appropriate chemical compound, or etchant, for a predetermined time duration. This determines the depth of removal of the metal material. The selection of the etchant is material-dependent, and for the present invention chemicals intended for metallographic examination and their variations can be used. Next, the remaining photoresist layer is stripped away and the pattern is revealed. Factors for controlling this process include metal cleaning, chemical mixing (for the photoresist, developer, etchant, and stripping compounds), speed of the part elevation to control photoresist thickness, and time duration of the etching.

The third category of method for forming the pattern of discrete, geometric shapes on the golf club face is precision micro-saw-cutting. One preferred example of this method uses a diamond saw blade having a diamond size of about 3 micrometers (microns), with the diamond particles being loaded into a resin bonded matrix to approximately 30% density. The blade dimensions are approximately 80 microns in thickness and 7.5 cm (3 inches) in diameter. A preferred cutting speed is 15,000 rpm, with a traverse speed of about 12.5 mm/second (0.5 inch/second). Alternatively, diamond blades ranging in thickness from 25 microns to about 500 microns can be used. Suitable diamond saws are available from Manufacturing Technology, Inc., of Ventura, Calif.

It should be appreciated from the foregoing description that the present invention provides a special golf club head having a forward striking surface configured to include an engineered texture in the form of a regular pattern of discrete, geometric shapes. These geometric shapes are spaced at least 0.1 mm apart from each other, and each shape has a volume of less than 0.0007 $mm^3$. Preferred methods of manufacturing the engineered texture of the forward striking surface include treating the surface by chemical etching, precision micro-saw-cutting, and laser cutting. The engineered texture enhances the performance of the golf club head upon striking a golf ball, providing one or more of the following benefits: an increased high backspin, a lower launch angle, and a higher ball speed, as compared to a golf club head not incorporating such an engineered texture.

Although the invention has been disclosed in detail with reference only to the presently preferred embodiments, those skilled in the art will appreciate that additional striking faces and methods for manufacturing golf club faces can be included without departing from the scope of the invention. Accordingly, the invention is defined only by the claims set forth below.

We claim:

1. A golf club head having a forward striking face, the forward striking face comprising:

a substantially planar recessed surface; and a plurality of discrete, solid geometric shapes projecting forward from the recessed surface, wherein each of the geometric shapes has a volume of less than 0.0007 $mm^3$, wherein the distance along the recessed surface between adjacent geometric shapes is at least 0.1 mm, and wherein the total volume of the geometric shapes contained within a square reference region on the forward striking face measuring 2.5 mm by 2.5 mm is less than 0.05 $mm^3$.

2. The golf club head of claim 1, wherein the total volume of geometric shapes contained within the reference region is less than 0.02 $mm^3$.

3. The golf club head of claim 1, wherein the total volume of geometric shapes contained within the reference region is less than 0.02 $mm^3$.

4. The golf club head of claim 1, wherein the total volume of geometric shapes contained within the reference region is less than 0.01 $mm^3$.

5. The golf club head of claim 1, wherein each of the geometric shapes has a volume of less than 0.0005 $mm^3$.

6. The golf club head of claim 1, wherein each of the geometric shapes has a volume of less than 0.0003 $mm^3$.

7. The golf club head of claim 1, further comprising a plurality of grooves formed in the forward striking face.

8. The golf club head of claim 1, wherein the geometric shapes are about identical in size and shape across the forward striking face.

9. The golf club head of claim 1, wherein the geometric shapes are spaced substantially evenly across the forward striking face.

10. The golf club head of claim 1, wherein the geometric shapes are formed as squares, diamonds, or circles.

11. The golf club head of claim 1, wherein the geometric shapes include a first plurality of geometric shapes and a second plurality of geometric shapes.

12. The golf club head of claim 1, each geometric shape having a depth measured from the recessed surface to a top portion of the geometric shape, wherein the depth is greater than or equal to 0.012 mm.

13. A wedge-type golf club head having a forward striking face defining a loft of at least 45°, the forward striking face comprising:

a substantially planar recessed surface;

a plurality of scorelines formed in the recessed surface; and a plurality of discrete, solid geometric shapes projecting from the recessed surface, the geometric shapes each having a volume of less than 0.0003 $mm^3$;

wherein adjacent geometric shapes are separated from each other along the recessed surface by a distance of at least 0.1 mm, and wherein the total volume of the geometric shapes contained within a square reference region on the forward striking face measuring 2.5 mm by 2.5 mm is less than 0.02 $mm^3$.

14. The golf club head of claim 13, wherein the reference region is disposed between two adjacent scorelines.

* * * * *